US005181320A

United States Patent [19]

Tucciarone

[11] Patent Number: 5,181,320

[45] Date of Patent: Jan. 26, 1993

[54] WALLPAPER TRIMMING TOOL AND ITS METHODS OF USE

[76] Inventor: John Tucciarone, 69 Whitman Ave., Staten Island, N.Y. 10308

[21] Appl. No.: 875,451

[22] Filed: Apr. 29, 1992

[51] Int. Cl.[5] ..... B25F 1/00; B26B 1/00; B26B 5/00; B28B 1/08

[52] U.S. Cl. ..... 30/123; 30/294; 30/320; 30/335

[58] Field of Search ..... 30/123, 169, 280, 289, 30/294, 305, 305, 313, 314, 320, 335

[56] References Cited

U.S. PATENT DOCUMENTS

| | | | |
|---|---|---|---|
| 1,619,249 | 3/1927 | Duff . | |
| 1,938,189 | 12/1933 | MacFarlane . | |
| 2,267,059 | 12/1941 | Voight | 30/320 |
| 2,404,141 | 7/1946 | Nelson | 30/320 |
| 2,674,794 | 4/1954 | Baker | 30/123 |
| 2,754,584 | 7/1956 | Ferguson . | |
| 3,436,823 | 4/1969 | Lamb et al. | 30/335 |
| 3,831,279 | 8/1974 | Burns | 30/294 |
| 4,408,396 | 10/1983 | Scholl | 30/294 |
| 4,955,138 | 9/1990 | Henke et al. . | |

*Primary Examiner*—Douglas D. Watts

*Assistant Examiner*—Paul M. Heyrana

*Attorney, Agent, or Firm*—Ladas & Parry

[57] ABSTRACT

A trimming tool for trimming the edges of wallpaper in which separate razor blades are supported on respective arms slidably mounted on a handle for movement between extended operative positions beyond the edge of a blade member secured to the handle. The arms are urged by springs to the retracted position in which the razor blades do not project beyond the edge of the blade member. Manually engageable projections are provided for the individual displacement of each arm to its extended position against the opposition of the springs, the arms being individually displaceable, one at a time, to bring the cutting edge of the associated razor blade beyond the edge of the blade member into its operative cutting position. When the tool is moved in one direction, the razor blade at one of the side regions of the blade member is extended to cut the wallpaper along a line of cut while the edge of the blade member guides the tool and when the tool is halted, the razor blade at the other of the end regions of the blade member is extended and the tool is moved in the reverse direction to complete the line of cut.

20 Claims, 4 Drawing Sheets

FIG. 3
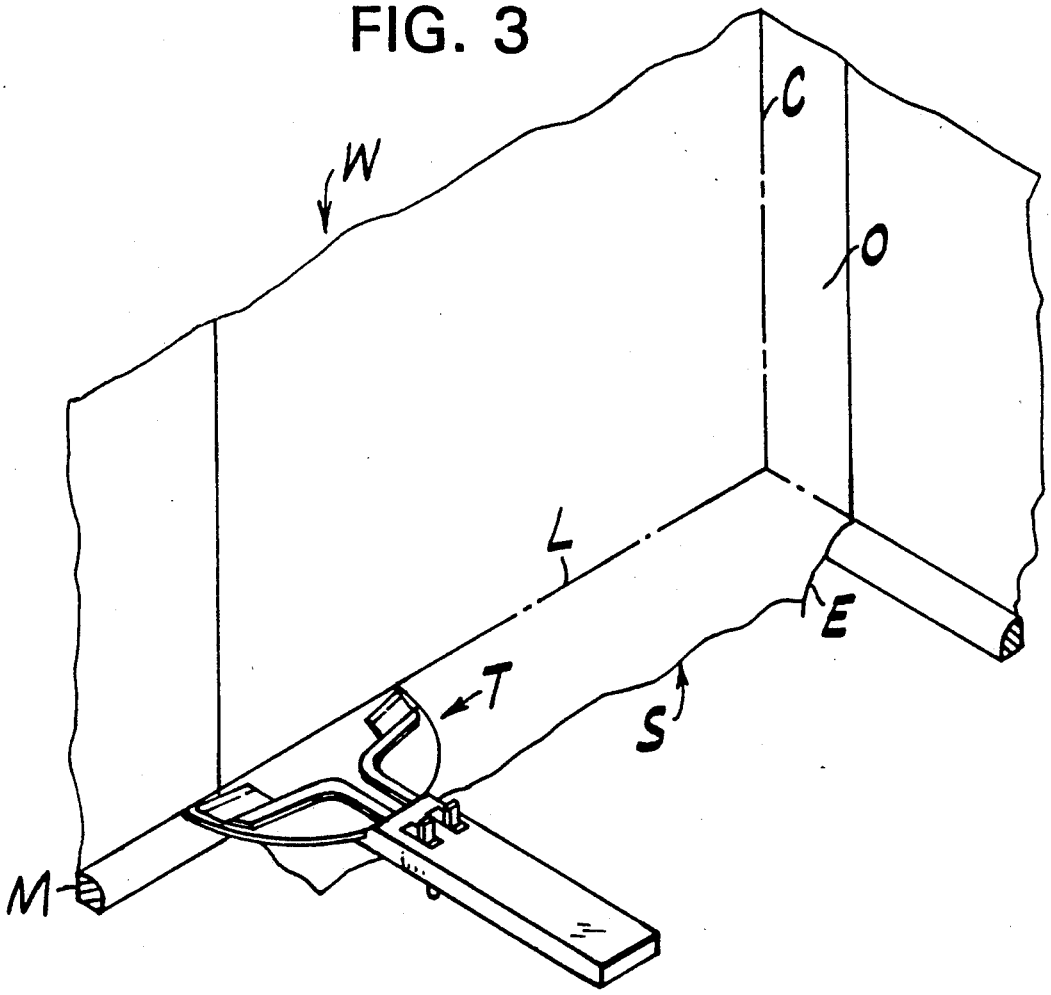
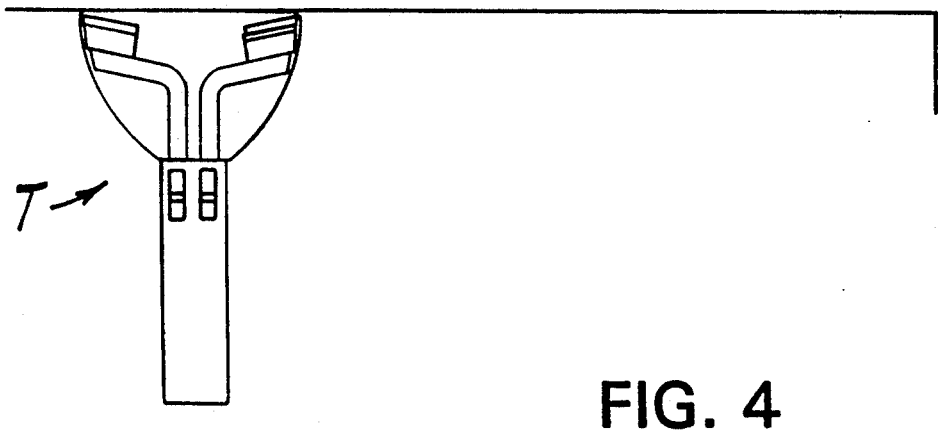
FIG. 4

WALLPAPER TRIMMING TOOL AND ITS METHODS OF USE

FIELD OF THE INVENTION

The invention relates to a wallpaper trimming tool and its method of use and particularly, to a trimming tool adapted for trimming the upper and lower edges of wallpaper, particularly in confined tight quarters such as at inside corners of walls.

BACKGROUND AND PRIOR ART

In conventional trimming of the upper and lower edges of wallpaper, the installer utilizes a scraper blade or other straight edge to hold the paper against the wall to maintain a straight edge and a separate tool holding a razor blade is utilized to cut the paper along the edge of the scraper or straight edge as a guide. This two-handed operation is relatively inefficient and time consuming and because of the separate blade holder and scraper blade, can lead to errors in cutting the wallpaper. Also, the use of a separate blade can lead to accidents in which the user can cut himself or herself.

Known in the art are various scraping tools in which a blade member is retractably supported on the body of a tool for scraping or cutting purposes. U.S. Pat. No. 1,938,189 (McFarlaine) shows a magazine blade holder of this type which carries razor blades in various operative positions for cutting purposes. U.S. Pat. No. 2,754,584 (Ferguson) shows a razor blade scraper in which the blade can be retracted within a housing or extended for operation. U.S. Pat. No. 4,955,138 (Henke, et al.) shows a tool employing single edged razor blades for removing paint or other materials, particularly from glass or similar hard smooth surfaces.

U.S. Pat. No. 1,619,249 (Duff) shows a blade holder which employs a razor blade for utility as a scraper for removing paint or the like or for use as a cutter for ripping or as a scoring blade. The tool comprises a holder carrying a razor blade which can be secured between retracted and extended positions. In an extended position a corner of the razor blade can be employed for cutting purposes in conjunction with a guide edge of the holder.

SUMMARY OF THE INVENTION

An object of the invention is to provide a trimming tool to cut the upper and lower edges of sheets of wallpaper during installation thereof.

A further object of the invention is to provide a trimming tool which can be utilized manually with one hand of the user thereby allowing the other hand to be employed, for example, in assisting the installation of the sheet of wallpaper.

A further object of the invention is to provide a trimming tool which will increase the speed and accuracy of the procedure of installing sheets of wallpaper.

Yet another object of the invention is to provide a trimming tool which will allow trimming of the upper and lower edges of sheets of wallpaper right up to corners of intersecting walls.

Another object of the invention is to provide a tool which is safe to use and substantially eliminates any danger of the user cutting himself or herself.

In accordance with the above and other objects of the invention, the trimming tool comprises a pair of oppositely disposed razor blades which are respectively movable between extended and retracted positions for trimming the edges of wallpaper in opposite directions of movement of the tool.

More specifically, the trimming tool comprises a handle having a blade member secured thereto with a guide edge of the blade member extending transversely of the handle and a pair of opposed arms slidably supported from the handle for movement longitudinally of the handle. A holder is provided on each arm for securing a razor blade therewith and the arms are urged to a retracted position in which the associated razor blades are juxtaposed on the blade member and do not project beyond the guide edge. Each arm is individually displaceable to an extended position against the opposition of the spring means by actuation of a manually engageable means. The razor blades have respective cutting edges which, in the extended position of the arms, ar disposed in proximity to and slightly beyond the guide edge of the blade member. The guide edge has opposite left and right end portions at which the razor blades are respectively disposed and the arms are individually displaceable to the extended positions, one at a time, to bring the cutting edge of the associated razor blade beyond the guide edge of the blade member.

The invention also contemplates a method of trimming an edge of a sheet of wallpaper during its mounting on a surface utilizing the tool wherein the guide edge of the blade member is engaged along a sheet of wallpaper which is to be cut along a line to form an edge of the sheet of wallpaper, whereafter a cutting edge of one of the razor blades carried by the tool at one side region of the guide edge is displaced by finger action to a position beyond the guide edge; then, the tool is advanced to cause the guide edge to travel along the line of cut of the wallpaper while the cutting edge of the razor blade projects beyond the guide edge and trails the guide edge to cut the wallpaper along said line of cut. The tool is halted, for example, when the blade member is blocked from further advance due to an intersecting wall or the like and the cutting edge of the extended razor blade is retracted and the second razor blade is displaced to its extended position at the opposite side region of the guide edge of the blade member and the tool is advanced in reverse direction to cause the cutting edge of the second razor blade to cut a remaining uncut portion of the wallpaper and complete said line of cut.

According to a feature of the invention, when both blades are retracted to their inoperative positions, the guide edge of the blade member can be used as a conventional scraper.

In further accordance with the invention, the manually engageable means for displacing each arm to its extended position comprises a projection on each arm extending at one side of the handle for engagement by a thumb of the user and a second projection at the other side of the handle for engagement by a finger of the user.

In still further accordance with the invention, the razor blades have outer side edges which are inclined at an acute angle relative to the cutting edges of the blades to form outer corners of the blades which extend beyond the guide edge of the blade member in the extended position of the blade. The razor blades are usable in reversed positions on both arms.

BRIEF DESCRIPTION OF THE FIGURES OF THE DRAWINGS

FIG. 3 is a diagrammatic perspective view showing application of the tool for purpose of producing a line of cut at the lower edge of a sheet of wallpaper.

FIG. 4 is a diagrammatic top view illustrating the arrangement in FIG. 3 in a first stage of trimming the wallpaper.

DETAILED DESCRIPTION OF THE INVENTION

Figure 1:
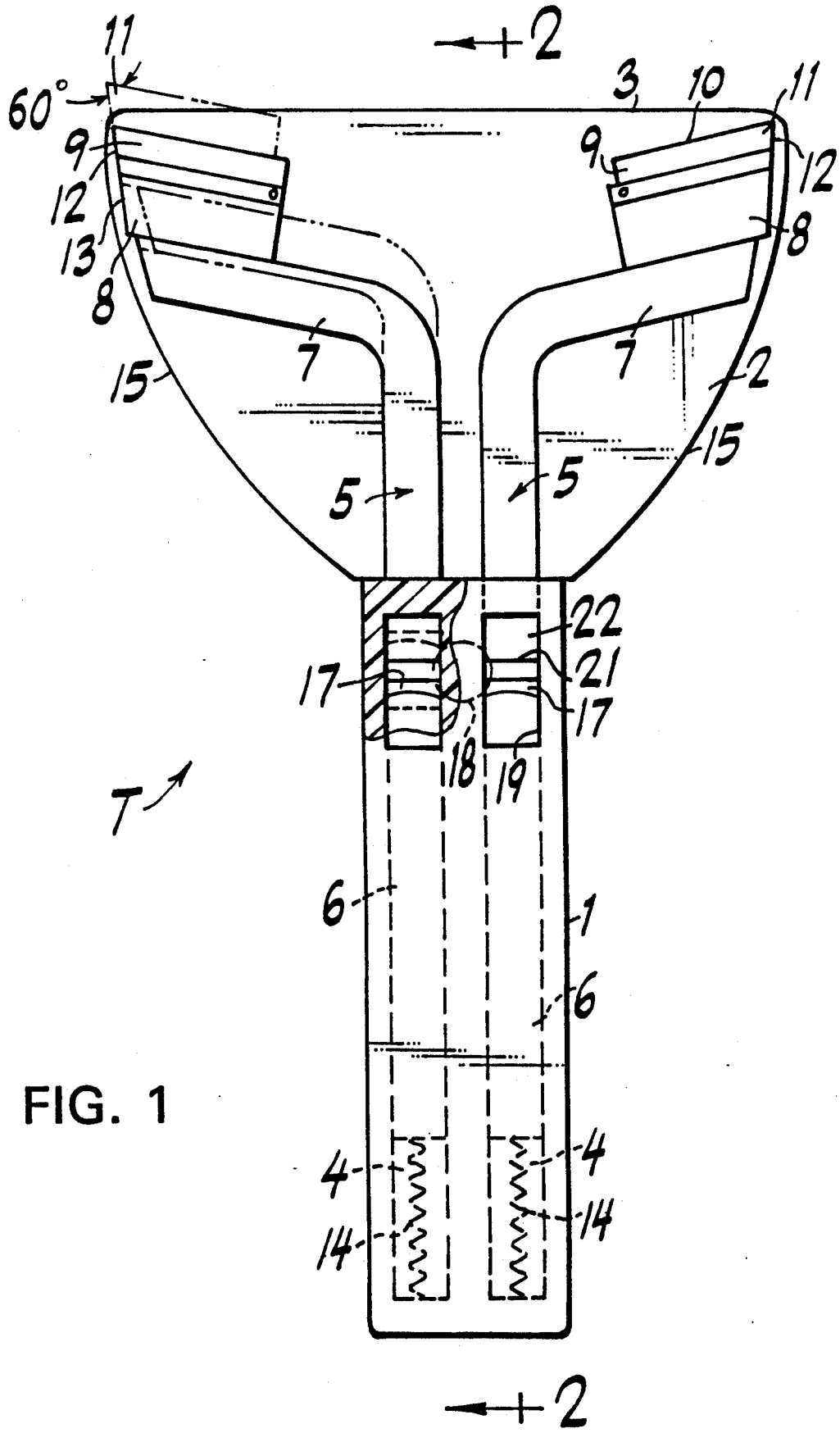
FIG. 1 is a top view, partly broken away in section of the trimming tool according to the invention.
Figure 2:
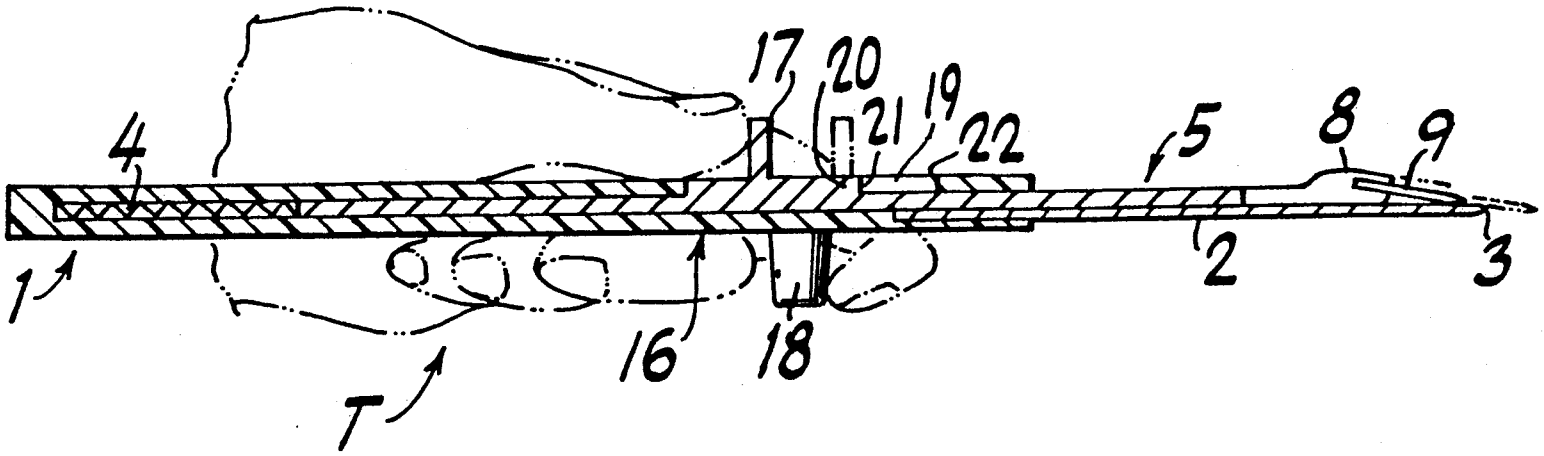
FIG. 2 is a sectional view taken along line 2—2 in FIG. 1.

FIGS. 1 and 2 show in detail a trimming tool T according to the invention which is adapted, for example, for trimming the upper and lower edges of a sheet of wallpaper upon its installation. The use of the tool will be explained later.

The tool T has an elongated handle 1 made of a strong and lightweight plastic material Fixed to the handle 1 at one end thereof is a blade member 2 having a rectilinear guide edge 3 extending transversely of the handle 1. The blade member 2 is made of metal and has slight flexibility in order to function as a conventional scraper blade. As in conventional scraper blades, the blade 2 is made of spring steel of a thickness of approximately 1/16th of an inch. The blade member 2 is slightly tapered at guide edge 3. The blade member 2 is attached to the handle 1 by being embedded fixedly in the handle.

The handle 1 is formed with two parallel slots 4 extending longitudinally of the handle and an arm 5 is slidably supported in each slot 4. Each arm 5 includes a straight portion 6 which is slidable in associated slot 4 and a bent portion 7 which is outside the slot. The bent portions 7 of the two arms 4 extend laterally from the parallel portions 6 in opposite outward directions. Each bent portion 7 supports a respective holder 8 at its end for a razor blade 9. The razor blade 9 is a single edge razor blade which is frictionally secured in the holder 8 and can be laterally displaced in the holder in order for its removal and replacement. The razor blade 9 has a straight cutting edge 10 which forms an outer cutting corner 11 with lateral side edge 12 of the razor blade. The holders 8 support the razor blades in an inwardly tilted position so that the cutting edges 10 of the razor blades are inclined inwardly of the blade member and downwardly of the handle to form an acute angle of between 10° and 20° with the guide edge 3. The lateral edge 12 of the razor blade and the lateral edge 13 of the holder 8 are in general alignment and form an acute angle with respect to the cutting edge 10 of the razor blade so that the blade forms an angle of about 60° at corner 11.

At the end of arm 5 remote from the holder 8, a spring 14 is mounted in slot 4 between the end of the arm and the handle 1 to normally urge the arm 5 rearwardly to a retracted position as shown in solid lines. In the retracted position, the side edges 12 and 13 of the razor blades 9 and holders 8 respectively are juxtaposed on the surface of the blade member 2 and confined within the perimetral edge 15 of the blade member 2. In the particular embodiment, the blade member 2 is of semi-elliptical shape but this can be varied within the scope of the invention. In the retracted position of the arms 5, the cutting edges 10 and the corners 11 of the razor blades 9 are also retracted within the perimetral edges 15 and the guide edge 3. In this configuration, the guide edge 3 extends rectilinearly across the blade member 2 without any projection therebeyond and by said razor blades, and the guide edge 3 can be used for conventional scraping or for pressing wallpaper into corners as will be explained in more detail later.

Each of the arms 5 is independently and respectively displaceable to an operative, extended position as shown for the left arm in FIG. 1 in dotted lines where the corner 11 of the razor blade 9 is brought into an extended or projecting position beyond the guide edge 3 of the blade member 2. In order to displace the arm 5 to its extended position, a manually engageable means 16 is provided. The manually engageable means 16 comprises an upstanding thumb-engaging projection 17 on each arm 5 and a finger-engaging projection 18 fixed to the handle 1 at a position between the two parallel arms 5. The upstanding projections 17 extend in one direction from the handle 1 while the finger-engaging projection 18 extends in the opposite direction. The handle 1 has a groove 19 in its upper surface which extends into the slot 4 and the thumb-projection 17 is fixed to a step 20 which is integrally formed on arm 5. The step 20 rides in groove 19.

In order to displace either of the arms 5 individually to move the associated razor blade 9 to its extended, operative position, the user engages his or her thumb against the thumb projection 17 on the particular arm 5 to be displaced and the forefinger on the finger-projection 18 and by applying a pressing action with the thumb to the projection 17 and a counter action by the forefinger to the finger-projection 18, the arm 5 can be displaced longitudinally as the straight portion 6 of the arm travels in slot 4 until an end edge 21 of step 20 abuts against an edge 22 of groove 19. In effect, the edge 22 of slot 19 serves as a stop for limiting the displacement of the arm 5 in its respective slot against the opposition of spring 14. Either arm 5 can be displaced to its operative position with the same hand of the user. The degree of projection of the corner 11 of the particular blade 9 to be utilized in a cutting operation is regulated by the user by thumb and finger pressure as a function of the thickness, toughness and type of material of the wallpaper.

The use of the tool for trimming the lower edge of a sheet of wallpaper will be illustrated with reference to FIGS. 3–7.

In FIG. 3, there is shown the lower right corner portion of a wall W on which a sheet S of wallpaper is being applied up to and beyond the corner C of the wall. The sheet S of wallpaper is first applied to the wall and its lower edge portion E extends beyond the bottom of the wall and needs to be trimmed off. At the bottom of the wall there is shown a molding M and the trimming of the bottom edge of the wallpaper is to take place along a line of cut L at the intersection of the top of the molding M and the wall W.

Figure 5:
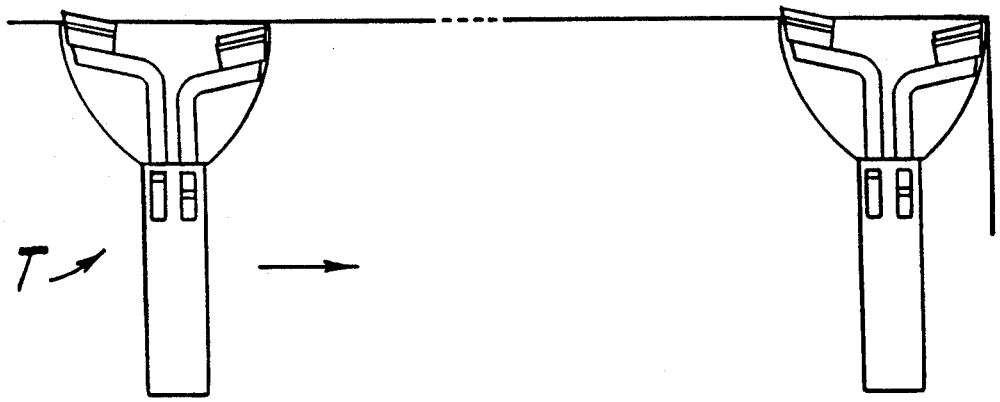
FIG. 5 shows the tool in its operative position in its travel from the initial position of the tool in the first stage to a final blocked position.
Figure 6:
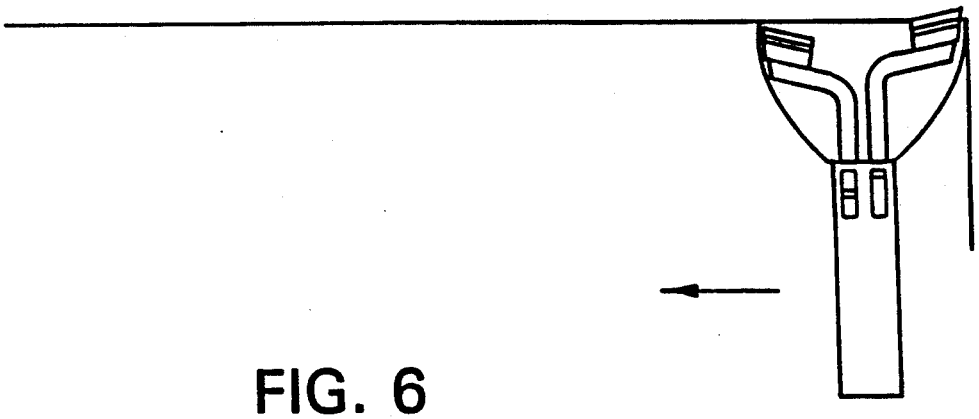
FIG. 6 shows the tool in a final stage for completing the line of cut.
Figure 7:
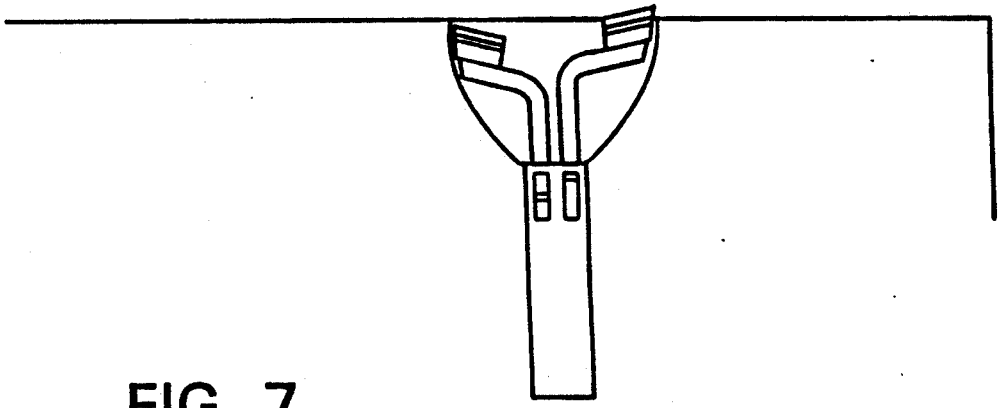
FIG. 7 shows the position of the tool at the completion of the line of cut.

With both razor blades 9 of the tool T retracted, the guide edge 3 of the blade member 2 can be used to press the wallpaper into the niche formed between the edge of molding M and the surface of wall W. This will produce a sharp crease in the wallpaper along the anticipated line of cut L. The tool T is the positioned at the left end of the wallpaper sheet S and with the thumb and forefinger of the user, the razor blade 9 at the left side of the tool is extended to its operative position as shown in FIG. 5 and is then moved to the right. In the course of this movement, the guide edge 3 of the tool is guided in the niche between the edge of the molding and the wall while the cutting edge 10 at the corner 11 of the extended razor blade trails the guide edge 3 and produces a cut along line L. When the tool approaches the end of wall W it is blocked from further travel by the intersecting wall and the tool is halted. The razor blade 9 at the left is retracted by releasing the manual engagement means 16 of the respective arms carrying the left razor blade and the razor blade 9 at the right is extended to its operative position, as shown in FIG. 6. The tool T is then moved in reverse direction to the left in order to complete the line of cut.

The cutting operation can be carried out with one hand and the other hand of the user can be used to smooth the wallpaper or assist the cutting operation by engaging the loose flap E of wallpaper below the line of cut. The cutting operation is carried out without need for making any additional cuts in the lower flap of the wallpaper as may be necessary when using a separate guide edge and cutting tool in the conventional way. The lower edge of the overlapped portion 0 of the wallpaper on the perpendicular wall can be trimmed by placing the tool with its left edge at the corner C and displacing the tool with the guide edge 3 along the niche at the intersection between the top of the molding M and the surface of the perpendicular wall while the razor blade 9 at the left corner of the tool T is extended into operative position. The cut is completed with a single stroke and the waste can be removed from the now installed wallpaper sheet.

The tool is also particularly effective when cutting overlapped seams of wallpaper as the tool can be moved in opposite directions to cut through the thickness of the overlapped sheets of wallpaper. This is especially advantageous when the wallpaper sheets are of heavy composition or are coated with acrylic material, which is hard and difficult to cut.

Although the invention has been described in relation to a specific embodiment thereof, it will become apparent to those skilled in the art that numerous modifications and variations can be made within the scope and spirit of the invention a defined in the attached claims.

What is claimed is:

1. A trimming tool for trimming the edges of wallpaper, comprising a handle, a blade member secured to said handle and having a guide edge extending traversely of said handle, a pair of opposed arms slidably supported from said handle for movement longitudinally of said handle, a holder on each arm for securing a razor blade therewith, spring means for urging said arms to a retracted position in which the associated razor blades are juxtaposed on the blade member and do not project beyond said guide edge, manually engageable means for the individual displacement of each arm to an extended position against the opposition of said spring means, said razor blades having respective cutting edges which in the extended position of said arms, are disposed in proximity to and slightly beyond the guide edge of said blade member, said guide edge having opposite left and right end regions at which said razor blades are respectively disposed, said arms being individually displaceable to said extended positions, one at a time, to bring the cutting edge of the associated razor blade beyond the guide edge of said blade member.

2. A trimming tool as claimed in claim 1, wherein said opposed arms are parallel.

3. A trimming tool as claimed in claim 1, wherein said manually engageable means comprises a projection on each arm for a thumb of a user.

4. A trimming tool as claimed in claim 3, wherein said projection is upstanding on its respective arm.

5. A trimming tool as claimed in claim 3, comprising a stop means on said handle for limiting displacement of said arms to said extended positions.

6. A trimming tool as claimed in claim 5, wherein said handle has longitudinal grooves through which the projections on the arms extend, said stop means comprising an edge of each groove which halts the respective arm in the extended position of said arm.

7. A trimming tool as claimed in claim 1, wherein said holders are constructed to hold said razor blades with their cutting edges inclined relative to said guide edge of said blade member.

8. A trimming tool as claimed in claim 7, wherein said cutting edges of the razor blades are inclined inwardly of said blade member and downwardly towards said handle.

9. A trimming tool as claimed in claim 7, wherein said cutting edges of said razor blades have outer edge portions which extend beyond said guide edge of said blade member when said arms are extended.

10. A trimming tool as claimed in claim 1, wherein said manually engageable means comprises first projections on said arms projecting beyond a first surface of said handle for individual engagement by a thumb of the user and a second projection on said handle projecting from a second surface of said handle in a direction opposite that of said first projections for engagement of a finger by the user.

11. A trimming tool as claimed in claim 1, wherein said arms include parallel portions guided in parallel slots provided in said handle, and lateral bent portions extending from said parallel portions away from one another, said holders being mounted on said bent portions at free ends thereof.

12. A trimming tool as claimed in claim 1, wherein said blade member is made of metal.

13. A trimming tool as claimed in claim 12, wherein said metal is spring steel.

14. A trimming tool as claimed in claim 12, wherein said handle is made of plastic material.

15. A trimming tool as claimed in claim 1, wherein said razor blades have outer side edges which are inclined at an acute angle relative to said cutting edges of the blades.

16. A trimming tool as claimed in claim 15, wherein said cutting edge and said outer side edge of each razor blade form an outer corner for said razor blade which extends beyond said guide edge of said blade member in the extended position of the associated arm.

17. A trimming tool as claimed in claim 16, wherein said holder of each razor blade has a side edge which is confined within a perimetral edge of said blade member in retracted and extended position of the associated arm.

18. A method of trimming an edge of a sheet of wallpaper during its mounting in a surface comprising:

engaging a rectilinear guide edge of a blade member of a tool along a sheet of wallpaper which is to be cut along a line to form an edge for the sheet of wallpaper;

displacing, by thumb and finger action, a cutting edge of a razor blade carried by said tool at one side region of the guide edge of the blade member such that said cutting edge projects beyond said guide edge;

advancing said tool along said line while holding the cutting edge of the razor blade in projected relation beyond said guide edge to cause said guide edge to travel along the line of cut of the wallpaper while the cutting edge of the razor blade trails said guide edge and cuts the wallpaper along said line of cut;

halting the tool;

retracting the cutting edge of the razor blade from beyond the guide edge of the blade member;

displacing by thumb and finger action a cutting edge of a second razor blade carried by the tool at the opposite side region of the guide edge of the blade member; and displacing the tool in reverse direction to cause the cutting edge of the second razor blade to cut along said line of cut.

19. A method as claimed in claim 18, comprising urging the retraction of the cutting edges of the razor blades by spring action and forming said guide edge as a scraping edge to enable its use for scraping purposes and for smoothly the wallpaper sheet when the cutting edges of the two razor blades are both retracted.

20. A method as claimed in claim 18, wherein said tool is halted before reaching an end of the line of cut and the tool is displaced in said reverse direction to cut a remaining uncut portion of the wallpaper to complete said line of cut.

* * * * *